US011054152B2

(12) United States Patent
Cho et al.

(10) Patent No.: US 11,054,152 B2
(45) Date of Patent: Jul. 6, 2021

(54) AIR CONDITIONER

(71) Applicant: SAMSUNG ELECTRONICS CO., LTD., Suwon-si (KR)

(72) Inventors: Sang Ki Cho, Seoul (KR); Ki Jun Kim, Suwon-si (KR); Dae Dong Kim, Yongin-si (KR); Chang Heon Lee, Yongin-si (KR); Moon Sun Shin, Suwon-si (KR); Young Lae Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 35 days.

(21) Appl. No.: 16/070,397

(22) PCT Filed: Aug. 1, 2017

(86) PCT No.: PCT/KR2017/008294
§ 371 (c)(1),
(2) Date: Jul. 16, 2018

(87) PCT Pub. No.: WO2018/074718
PCT Pub. Date: Apr. 26, 2018

(65) Prior Publication Data

US 2019/0056120 A1 Feb. 21, 2019

(30) Foreign Application Priority Data

Oct. 21, 2016 (KR) ..... 10-2016-0137924

(51) Int. Cl.
*F24F 13/14* (2006.01)
*F24F 11/79* (2018.01)
(Continued)

(52) U.S. Cl.
CPC ..... *F24F 1/0014* (2013.01); *F24F 11/00* (2013.01); *F24F 13/14* (2013.01); *F24F 13/20* (2013.01);
(Continued)

(58) Field of Classification Search
CPC ..... F24F 1/0014; F24F 1/0022; F24F 1/0057; F24F 11/79; F24F 13/14; F24F 13/1413; F24F 13/20
See application file for complete search history.

(56) References Cited

U.S. PATENT DOCUMENTS 9,255,722 B2 * 2/2016 Kim ..... F24F 13/1413
10,458,673 B2 * 10/2019 Cho ..... F24F 13/14
(Continued)

FOREIGN PATENT DOCUMENTS

CN 105180267 12/2015
EP 2518418 10/2012
(Continued)

OTHER PUBLICATIONS

International Search Report dated Nov. 15, 2017 in corresponding International Patent Application No. PCT/KR2017/008294.
(Continued)

*Primary Examiner* — Leonard R Leo
(74) *Attorney, Agent, or Firm* — Staas & Halsey LLP

(57) ABSTRACT

An air conditioner includes a heat exchanger configured to exchange heat with air introduced into a housing and a blowing fan configured to blow the air which is heat-exchanged with the heat exchanger to outside of the housing. The air conditioner may control a first and a second doors configured to open or close a first and second blowing ports provided in the housing and a guide blade configured to control paths in the housing, so that the air conditioner may blow the air of various flow.

11 Claims, 11 Drawing Sheets

(51) Int. Cl.

| | |
|---|---|
| ***F24F 1/0014*** | (2019.01) |
| ***F24F 13/20*** | (2006.01) |
| ***F24F 11/00*** | (2018.01) |
| *F24F 1/0022* | (2019.01) |

(52) U.S. Cl.
CPC ..... *F24F 1/0022* (2013.01); *F24F 11/79* (2018.01); *F24F 13/1413* (2013.01)

(56) References Cited

U.S. PATENT DOCUMENTS

| | | | | |
|---|---|---|---|---|
| 2010/0307717 | A1* | 12/2010 | Yamashita | F24F 1/0011 165/96 |
| 2018/0119984 | A1* | 5/2018 | Cho | F24F 13/14 |

FOREIGN PATENT DOCUMENTS

| | | | | | |
|---|---|---|---|---|---|
| EP | 2719969 | | | 4/2014 | |
| JP | 61-63620 | | | 4/1986 | |
| JP | 61-138947 | | | 8/1986 | |
| JP | 11-237067 | | | 8/1999 | |
| JP | 11237067 | A | * | 8/1999 | F24F 1/0014 |
| JP | 2008-151477 | | | 7/2008 | |
| JP | 2016099030 | A | * | 5/2016 | |
| KR | 2001-0001964 | | | 1/2001 | |
| KR | 10-2007-0073142 | | | 7/2007 | |
| KR | 10-0878472 | | | 1/2009 | |

OTHER PUBLICATIONS

Written Opinion of the International Searching Authority dated Nov. 15, 2017 in corresponding International Patent Application No. PCT/KR2017/008294.

Extended European Search Report dated Mar. 22, 2019 in European Patent Application No. 17861879.9.

Indian Office Action dated Oct. 7, 2020, in corresponding Indian Patent Application No. 201917019736.

* cited by examiner

AIR CONDITIONER

This application is a U.S. National Stage Application, which claims the benefit under 35 U.S.C. § 371 of International Patent Application No. PCT/KR2017/008294 filed on Aug. 1, 2017, which claims the foreign priority benefit under 35 U.S.C. § 119 of Korean Patent Application No. 10-2016-0137924, filed Oct. 21, 2016, the contents of which are incorporated herein by reference.

TECHNICAL FIELD

The present invention relates to an air conditioner, and more particularly, to an air conditioner having various methods of discharging air and configured to control a flow of discharged air.

BACKGROUND ART

Generally, air conditioners are apparatuses configured to adjust temperature, humidity, air flow, distribution, and the like to be suitable for human activity using a refrigeration cycle, and to remove dust in the air. A compressor, a condenser, an evaporator, a blowing fan and the like are provided as components forming the refrigeration cycle.

The air conditioner can be classified into a separate type air conditioner in which an indoor unit and an outdoor unit are separately installed, and an integral type air conditioner in which an indoor unit and an outdoor unit are integrally installed in one cabinet. The indoor unit of the separate type air conditioner includes a heat exchanger configured to exchange heat with air introduced into a panel, and a blowing fan configured to suction indoor air into the panel and blow the suctioned air back out to an indoor space.

An indoor unit of a conventional air conditioner was manufactured in a type in which a heat exchanger is minimized, and a volume and velocity of air are maximized by increasing RPM of a blowing fan. Accordingly, a discharge temperature was lowered, and discharged air was discharged to an indoor space by forming a narrow and long path.

When a user directly comes into contact with the discharged air, the user can feel coldness and displeasure. On the other hand, when the user does not come into contact with the discharged air, the user feels heat and displeasure.

Further, when a rotational speed of the blowing fan is increased for implementing a fast velocity of the air, noise increases. In the case of a radiant air conditioner configured to condition air without using the blowing fan, a large panel is necessary for implementing performance identical to that of an air conditioner using the blowing fan. Further, a cooling rate is also very slow and construction costs are high.

TECHNICAL PROBLEM

One aspect of the present invention provides an air conditioner configured to variously control a flow of discharged air.

Another aspect of the present invention provides an air conditioner having various methods of discharging air Still another aspect of the present invention provides an air conditioner configured to cool and heat an indoor space at a minimum speed in which a user feels comfort.

TECHNICAL SOLUTION

In accordance with an aspect of the present invention, an air conditioner may include a housing having a first blowing port and a second blowing port; a blowing fan configured to suction air into the housing to flow the air to the first blowing port or the second blowing port; a first door configured to open or close the first blowing port; a second door configured to open or close the second blowing port; and a guide blade configured to be movable to a first position which guides the air blown from the blowing fan to the first blowing port, and to a second position which guides the air blown from the blowing fan to the second blowing port.

The first door may include a plurality of holes to discharge the air inside the housing when the first door closes the first blowing port.

The first door may include a first blade configured to open or close the first blowing port, and a second blade spaced apart from the first blade and configured to overlap at least a part of the first blade.

The guide blade may close a path toward the first blowing port together with the second blade at the second position.

The plurality of holes may be formed in the first blade.

The second door may include a plurality of holes to discharge the air inside the housing when the second door closes the second blowing port.

The second door may include a first blade configured to open or close the second blowing port, and a second blade spaced apart from the first blade and configured to overlap at least a part of the first blade.

The plurality of holes may be formed in the first blade.

A lower end of the second door may be hinge-coupled to the housing so that the air discharged from the second blowing port is guided in an upward direction.

The housing may include a plurality of holes to discharge the air inside the housing when the first blowing port and the second blowing port are closed.

The guide blade may include a plurality of holes to flow an air to the first blowing port at the second position.

In accordance with an aspect of the present invention, an air conditioner may include a housing having a body which has a first blowing port and a front panel which has a second blowing port; a blowing fan configured to suction air into the housing to flow the air to the first blowing port or the second blowing port; a first door configured to open or close the first blowing port and having a plurality of first holes to discharge the air inside the housing when the first door closes the first blowing port; and a second door configured to open or close the second blowing port and having a plurality of second holes to discharge the air inside the housing when the second door closes the second blowing port.

The air conditioner may further include a guide blade configured to guide the air blown from the blowing fan to one of a first path toward the first blowing port and a second path toward the second blowing port.

The second blowing port may be disposed in an upper portion of the front panel.

The second blowing port may be disposed in the center of the front panel.

The front panel may include a plurality of third holes to discharge the air from the periphery of the second blowing port.

The first holes may have a diameter different from diameters of the second holes and the third holes.

The first holes may have a diameter smaller than diameters of the second holes and the third holes.

In accordance with an aspect of the present invention, an air conditioner may include a body having a first blowing port; a front panel having a second blowing port and a plurality of first holes configured to discharge an air from the periphery of the second blowing port; a duct formed by at least a part of the body and the front panel; a blowing fan configured to suction air into the housing to flow the air to the first blowing port or the second blowing port; a first door configured to open or close the first blowing port; and a second door configured to open or close the second blowing port.

The air conditioner may further include a guide blade configured to open or close the duct.

ADVANTAGEOUS EFFECTS

An air conditioner according to an aspect of the present invention can blow a flow of heat-exchanged air varied according to a using environment by varying an air flow.

Further, an air conditioner according to an aspect of the present invention can discharge heat-exchanged air at a varied velocity.

Further, since an air conditioner according to an aspect of the present invention can cool and heat an indoor space without blowing air directly to a user, the user's satisfaction can be improved.

MODES OF THE INVENTION

Figure 1:
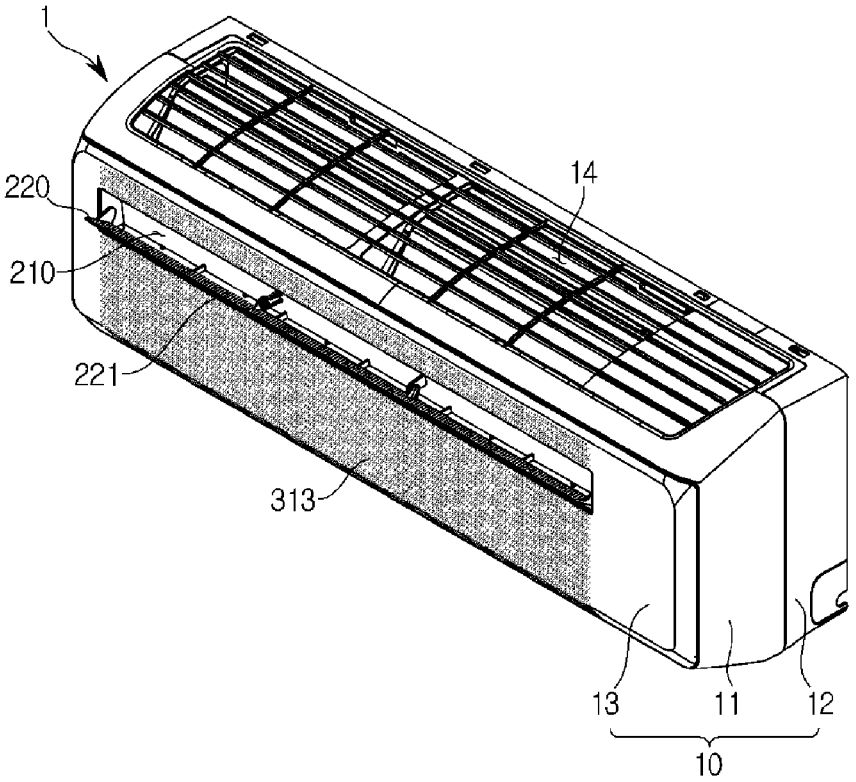
FIG. 1 is a perspective view of an air conditioner according to one embodiment of the present invention viewed from above.

Embodiments described in the specification and configurations shown in the accompanying drawings are merely exemplary examples of the present invention, and various modifications may replace the embodiments and the drawings of the present invention at a time at which the present application is filed.

Further, identical symbols or numbers in the drawings of the present invention denote components or elements configured to perform substantially identical functions.

Further, terms used herein are only for the purpose of describing particular embodiments and are not intended to limit the present invention. The singular form is intended to also include the plural form, unless the context clearly indicates otherwise. It should be further understood that the terms "include," "including," "provide," "providing," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," and the like may be used herein to describe various elements, the elements are not limited by the terms, and the terms are only used to distinguish one element from another. For example, a first element could be termed a second element, and similarly, a second element could be termed a first element without departing from the scope of the present invention. The term "and/or" includes combinations of one or all of a plurality of associated listed items.

Meanwhile, the terms "front end," "rear end," "upper portion," "lower portion," "upper end," "lower end," etc. used in the below-described descriptions are defined on the basis of the drawings, and a shape and a location of each component are not restrained by the terms.

Hereinafter, embodiments according to the present invention will be described in detail with reference to the accompanying drawings.

A refrigeration cycle forming an air conditioner includes a compressor, a condenser, an expansion valve, and an evaporator. A refrigerant is subjected to a series of cycles including compression, condensation, expansion, and evaporation, and after hot air is heat-exchanged with a cold refrigerant, cold air is supplied to an indoor space.

The compressor compresses a refrigerant gas in a high temperature and high pressure state and then discharges the refrigerant gas, and the discharged refrigerant gas is introduced into the condenser. The condenser condenses the compressed refrigerant into a liquid state, and releases heat to its surroundings through a condensation process. The expansion valve expands the liquid refrigerant in the high temperature and high pressure state condensed by the condenser, to a liquid refrigerant in a low pressure state. The evaporator evaporates the refrigerant expanded by the expansion valve. The evaporator achieves a refrigeration effect due to exchanging heat between a cooled object and the refrigerant using evaporative latent heat of the refrigerant, and returns the refrigerant gas in a low temperature and low pressure state to the compressor. An indoor air temperature may be adjusted by the above-described cycle.

An outdoor unit of the air conditioner is a part including the compressor and an outdoor heat exchanger among the refrigeration cycle. The expansion valve may be in one of the indoor unit and the outdoor unit, and an indoor heat exchanger is in the indoor unit of the air conditioner.

The present invention relates to an air conditioner configured to cool an indoor space, an outdoor heat exchanger serves as a condenser, and an indoor heat exchanger serves as an evaporator. Hereinafter, for convenience, the indoor unit including the indoor heat exchanger will be referred to as an air conditioner, and the indoor heat exchanger will be referred to as a heat exchanger.

Figure 2:
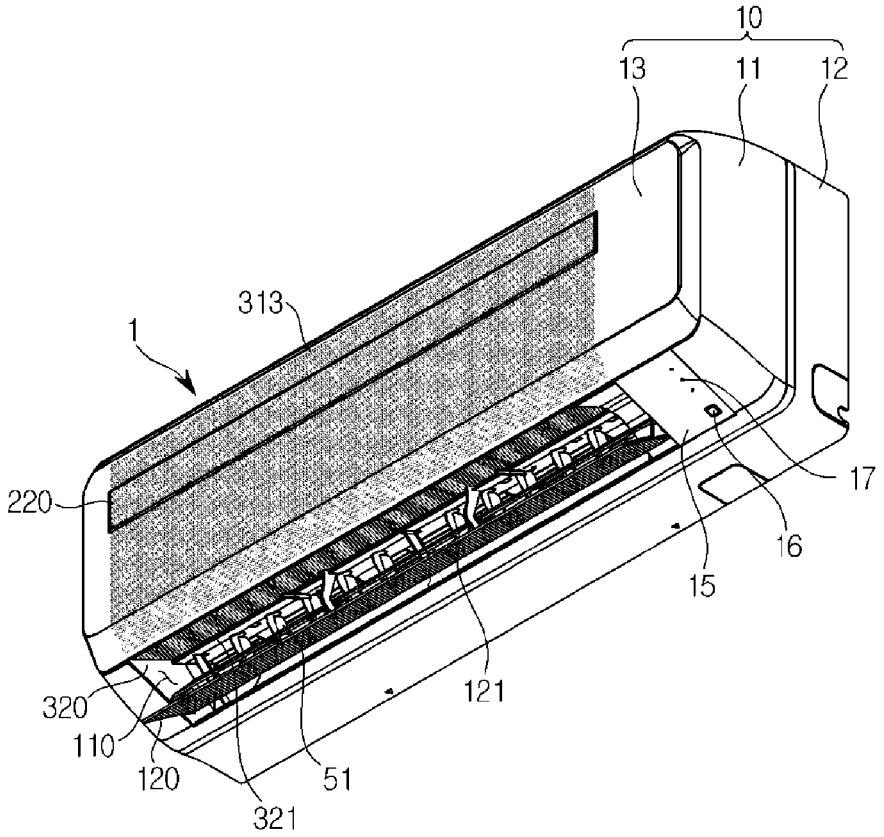
FIG. 2 is a perspective view of the air conditioner according to one embodiment of the present invention viewed from below.
Figure 3:
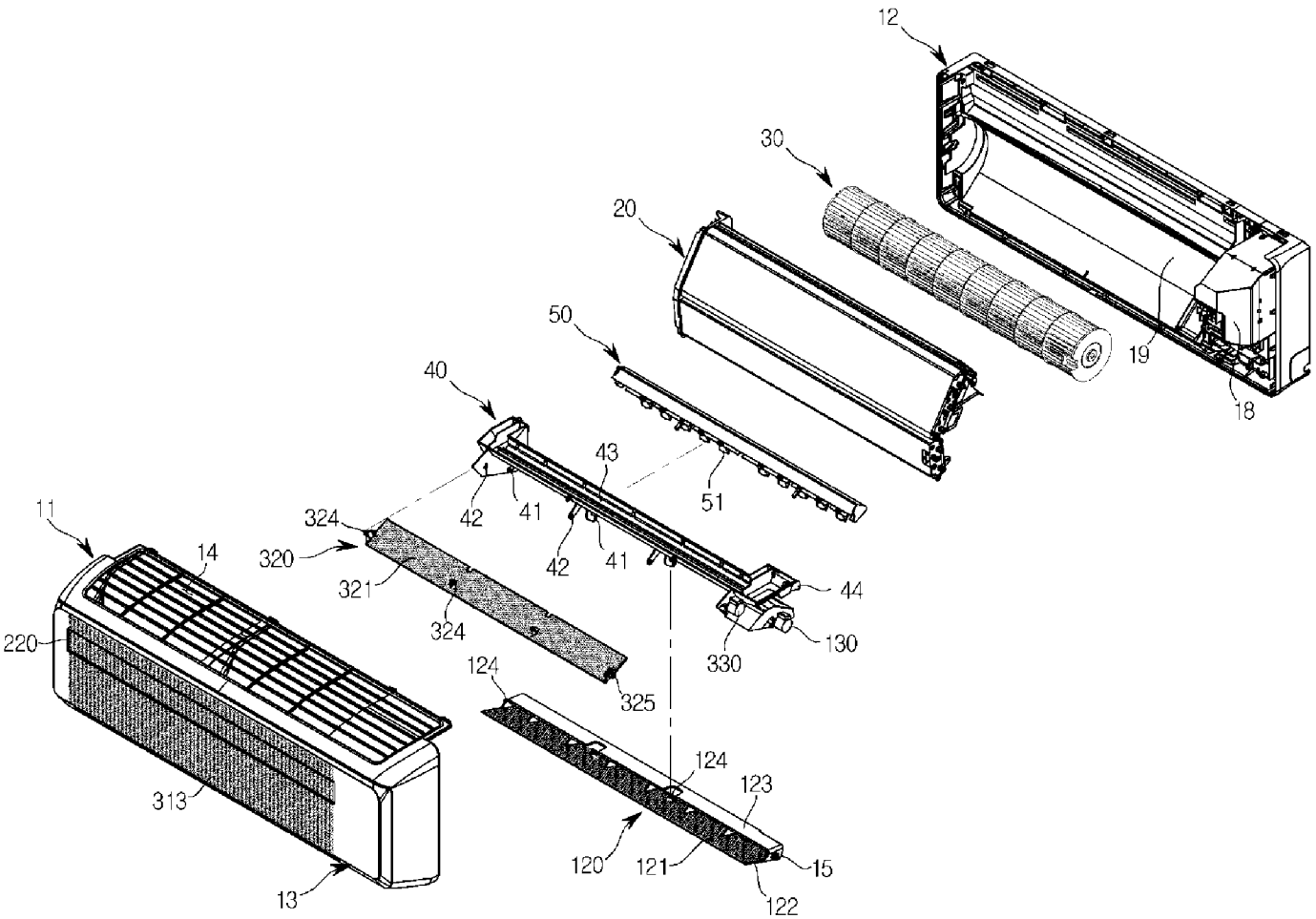
FIG. 3 is an exploded perspective view illustrating a partial configuration of the air conditioner according to one embodiment of the present invention.
Figure 4:
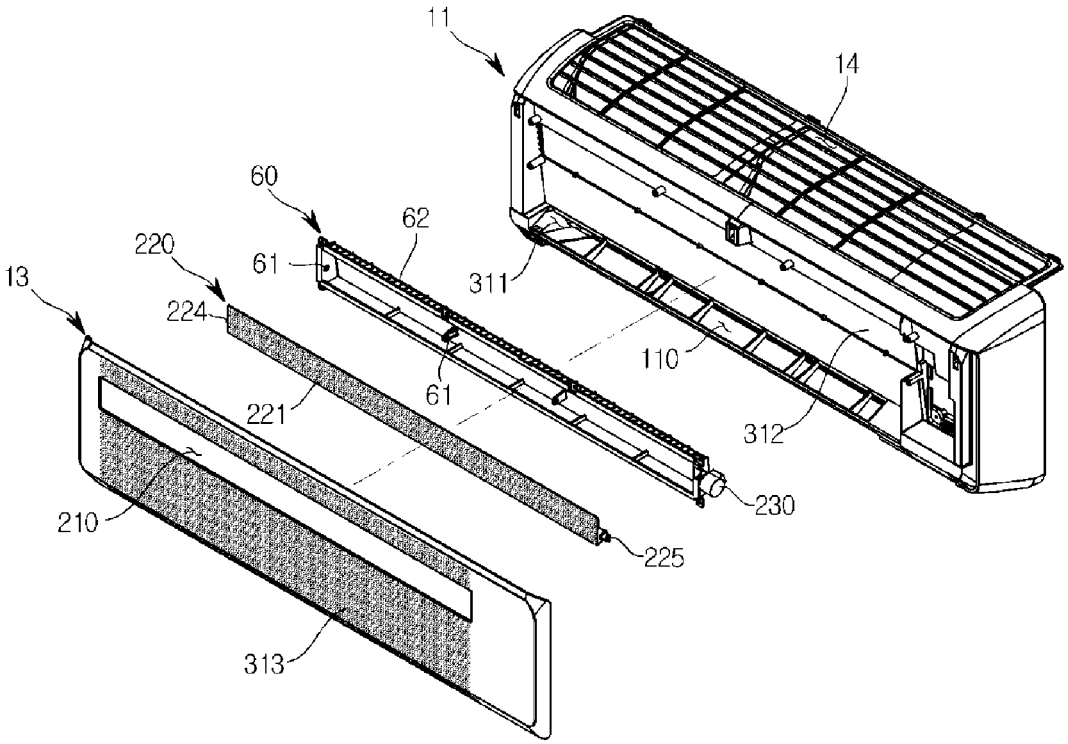
FIG. 4 is an exploded perspective view illustrating another partial configuration of the air conditioner according to one embodiment of the present invention.
Figure 5:
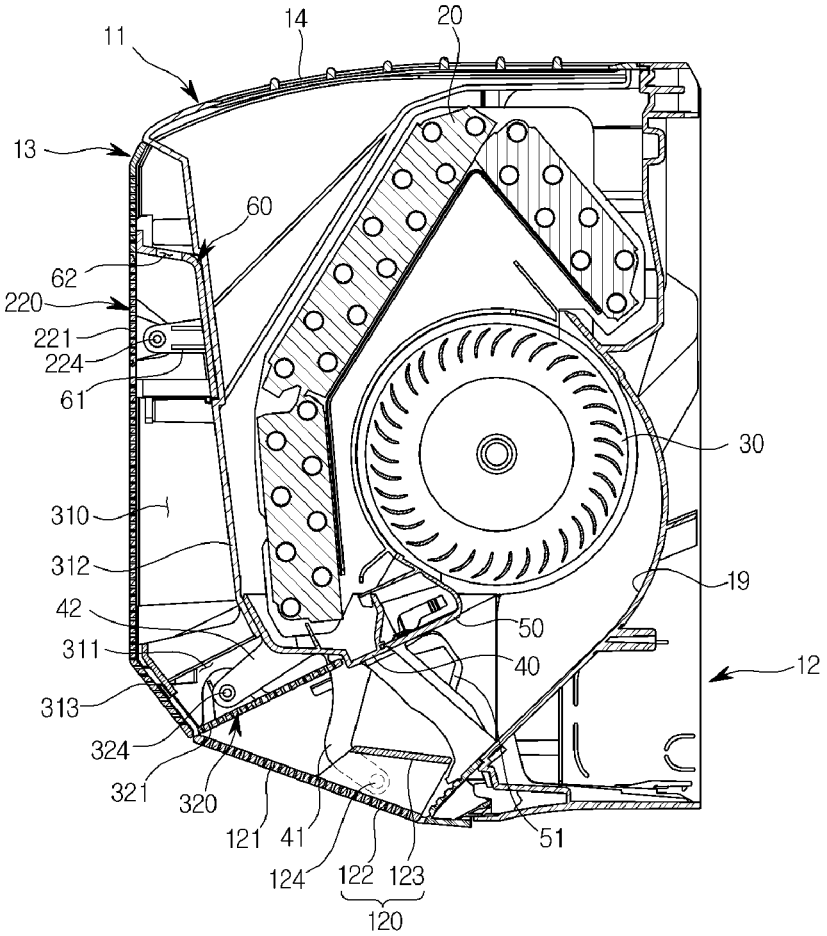
FIG. 5 is a cross-sectional view of the air conditioner according to one embodiment of the present invention.

FIG. 1 is a perspective view of an air conditioner according to one embodiment of the present invention viewed from above, and FIG. 2 is a perspective view of the air conditioner according to one embodiment of the present invention viewed from below. FIG. 3 is an exploded perspective view illustrating a partial configuration of the air conditioner according to one embodiment of the present invention, and FIG. 4 is an exploded perspective view illustrating another partial configuration of the air conditioner according to one embodiment of the present invention. FIG. 5 is a cross-sectional view of the air conditioner according to one embodiment of the present invention.

Referring to FIGS. 1 to 5, an air conditioner 1 may include a housing 10 having a suction port 14 and blowing ports 110 and 210, a heat exchanger 20 disposed inside the housing 10 and configured to heat-exchange with air introduced into the housing 10, and a blowing fan 30 configured to suction the air into the housing 10 to flow the air to the blowing ports 110 and 210.

The air conditioner 1 may include the plurality of blowing ports 110 and 210. That is, the housing 10 of the air conditioner 1 may include a first blowing port 110 and a second blowing port 210. Further, the air conditioner 1 may include a first door 120 configured to open or close the first blowing port 110, and a second door 220 configured to open or close the second blowing port 210.

The housing 10 may have a rectangular parallelepiped shape of which a length of a widthwise direction is longer than a length of a lengthwise direction, and the first blowing port 110 and the second blowing port 210 may each be formed in a rectangular shape to correspond to the length of the housing 10. Further, the first door 120 and the second door 220 may each be formed in a rectangular shape to correspond to the first blowing port 110 and the second blowing port 210.

The first door 120 may include a plurality of first holes 121 to discharge the air inside the housing 10 when the first door 120 closes the first blowing port 110, and the second door 220 may include a plurality of second holes 221 to discharge the air inside the housing 10 when the second door 220 closes the second blowing port 210.

Since the first blowing port 110 and the second blowing port 210 are each selectively opened or closed by the first door 120 and the second door 220, the air conditioner 1 may control a flow such as a direction, a volume, or the like of discharged air.

The housing 10 may include bodies 11 and 12, and a front panel 13 coupled to a front surface of each of the bodies 11 and 12. The bodies 11 and 12 may include the first blowing port 110, and the front panel 13 may include the second blowing port 210.

The air conditioner 1 may be provided to be installed on a wall. The bodies 11 and 12 may each include a rear housing 12 fixed to the wall and a front housing 11 coupled to the rear housing 12, and the front panel 13 may be coupled to a front surface of the front housing 11 of the housing 10.

The heat exchanger 20, the blowing fan 30 and the like may be accommodated in an inner space between the bodies 11 and 12 formed by the front housing 11 and the rear housing 12. The suction port 14 capable of suctioning air into the inner space between the bodies 11 and 12 may be provided in an upper portion of the front housing 11. Further, the first blowing port 110 capable of blowing the air blown from the blowing fan 30 outward from the housing 10 may be installed in a lower portion of the front housing 11.

A control panel 15 may be coupled to the lower portion of the front housing 11. The control panel 15 may include a receiver 16 configured to receive signals from a remote controller, a display 17 configured to display an operation state of the air conditioner 1, and the like. Further, a printed circuit board and the like configured to operate the receiver 16 or the display 17 may be provided inside the control panel 15.

The front panel 13 may form a duct 310 together with at least a part 312 of the bodies 11 and 12. Specifically, the duct 310 may be formed by the front panel 13 and a front outer side surface 312 of the front housing 11. The front panel 13 may include the second blowing port 210, and the duct 310 may provide a path through which air blown from the inner space between the bodies 11 and 12 may flow to the second blowing port 210.

The air conditioner 1 may include a guide blade 320 configured to open or close an entrance 311 of the duct 310. The guide blade 320 may be configured to be movable to a first position which guides the air blown from the blowing fan 30 to the first blowing port 110, and to a second position which guides the air blown from the blowing fan 30 to the second blowing port 210. That is, the guide blade 320 may be configured to be movable to the first position in which the entrance 311 of the duct 310 is closed and the second position in which the entrance of the duct 310 is open.

The housing 10 may include a plurality of third holes 313 to discharge the air in the housing 10 when the first blowing port 110 and the second blowing port 210 are closed. Specifically, the front panel 13 may include the plurality of third holes 313 configured to discharge the air from the periphery of the second blowing port 210. Although not shown in the drawings, the plurality of third holes 313 may also be formed in a side surface, a lower surface, or the like of the housing 10.

The air conditioner 1 may discharge the air in the housing 10 through the plurality of first holes 121 and the plurality of second holes 221 each formed in the first door 120 and the second door 120, and the plurality of third holes 313 formed in the housing 10 when the first blowing port 110 and the second blowing port 210 are closed.

The heat exchanger 20 is disposed inside the housing 10 and configured to heat-exchange with the air introduced into the suction port 14. That is, the heat exchanger 20 is configured to absorb heat from the air introduced into the suction port 14 or transfer heat to the air introduced into the suction port 14.

The suction port 14 may be formed in a rectangular shape to correspond to the length of the housing 10, and the heat exchanger 20 may be formed to have a length corresponding to that of the suction port 14. The heat exchanger 20 may each be disposed between the suction port 14 and the blowing fan 30 to surround a part of the blowing fan 30. Although not shown in the drawings, the heat exchanger may be disposed between the blowing fan and the blowing port.

Although not shown in the drawings, a filter (not shown) may be attached to the suction port 14 of the housing 10. The filter may filter foreign substances such as dirt included in the external air suctioned into the suction port 14. Further, the air conditioner 1 may further include an additional filter provided in the housing 10 and configured to absorb and filter foreign substances such as dirt, odor particles and the like included in the air.

A cross flow fan formed to correspond to the shape and length of the housing 10 may be applied as the blowing fan 30. That is, the blowing fan 30 may be disposed to have a rotary shaft parallel to the suction port 14 and the blowing ports 110 and 210. The blowing fan 30 may be rotatably mounted in the rear housing 12, and may be rotated by a fan motor (not shown) mounted in the rear housing 12. An operating part 18 including the fan motor configured to drive the blowing fan 30, a circuit board capable of operating other components of the air conditioner 1, and the like may be provided in the rear housing 13.

The housing 10 may include a first support member 40 on which various components of the air conditioner 1 may be mounted therein. The first support member 40 may be disposed on a lower portion of the heat exchanger 20, and attached to the rear housing 12. The first support member 40 may include a water container 43 in which water condensed by the heat exchanger 20 is collected, and a drain pipe 44 configured to drain the water collected in the water container 43.

A stabilizer 50 configured to determine a blowing direction of the blowing fan 30 may be mounted in the first support member 40. The stabilizer 50 may be formed to surround a part of the blowing fan 30 with a predetermined interval from the blowing fan 30 to separate an air suction path and an air discharge path of the blowing fan 30, and may be formed to determine a position and intensity of the vortex of the discharged air.

The rear housing 12 may include a rear guide surface 19 formed in the shape of a curved surface to surround a part of the blowing fan 30. The stabilizer 50 and the rear guide surface 19 may form the air discharge path of the blowing fan 30. A plurality of fins 51 configured to guide air discharged through the path formed by the stabilizer 50 and the rear guide surface 19 in a horizontal direction may be provided on a lower surface of the stabilizer 50. The plurality of fins 51 may guide the air blown by horizontal rotation of the plurality of fins 51 in the horizontal direction.

The first door 120 and the guide blade 320 may be rotatably mounted in the first support member 40. Further, a first motor 130 configured to drive the first door 120 and a second motor 330 configured to drive the guide blade 320 may be mounted on the first support member 40.

The first door 120 may include a plurality of first hinge protrusions 124 and a first motor connection shaft 125. The plurality of first hinge protrusions 124 of the first door 120 are connected to a plurality of first hinge portions 41 provided on the first support member 40, and the first motor connection shaft 125 of the first door 120 is connected to the first motor 130 mounted in the first support member 40. Since the first hinge protrusions 124 and the first motor connection shaft 125 are coaxially provided, the first door 120 may be rotated by the first motor 130. The first door 120 may guide the air discharged from the first blowing port 110 by vertical rotation of the first door 120 in a vertical direction.

The first door 120 may include a first blade 122 configured to open or close the first blowing port 110, and a second blade 123 spaced apart from the first blade 122 and configured to overlap at least a part of the first blade 122. That is, the second blade 123 may be provided to be spaced apart from the first blade 122, but may be formed to have a lengthwise width smaller than that of the first blade 122.

The plurality of first holes 121 formed in the first door 120 may be formed in the first blade 122. Although not shown in the drawings, the plurality of first holes may also be formed in the second blade 123. Meanwhile, when holes are not formed in the second blade 123 of the first door 120, the air blown from the blowing fan 30 may be helped to be curved toward the duct 310.

The guide blade 320 may include a plurality of second hinge protrusions 324 and a second motor connection shaft 325. The plurality of second hinge protrusions 324 of the guide blade 320 are connected to a plurality of second hinge portions 42 provided on the first support member 40, and the second motor connection shaft 325 of the guide blade 320 is connected to the second motor 330 mounted in the first support member 40. Since the second hinge protrusions 324 and the second motor connection shaft 325 are coaxially provided, the guide blade 320 may be rotated by the second motor 330.

Although not shown in the drawings, the guide blade may be provided to be rotatable to the first position or the second position by a manual operation of a user. The guide blade may include a manually rotatable handle.

The guide blade 320 may include a plurality of fourth holes 321 to flow the air to the first blowing port 110 at the second position, in which the entrance 311 of the duct 310 is open. That is, when the first blowing port 110 and the second blowing port 120 are closed, the guide blade 320 may flow the air to the first blowing port 110 through the plurality of fourth holes 321 at the second position, which guides the air blown from the blowing fan 30 to the second blowing port 210.

The housing 10 may include a second support member 60 on which still other components of the air conditioner 1 may be mounted. The second support member 60 may be attached to the front outer side surface 312 of the front housing 11. That is, the second support member 60 may be disposed in the duct 310, and the second door 220 may be rotatably mounted on the second support member 60. Through holes may be provided in an upper surface of the second support member 60 so that the duct 310 is not closed by the second support member 60.

The second door 220 may include a plurality of third hinge protrusions 224 and a third motor connection shaft 225. The plurality of third hinge protrusions 224 of the second door 220 are connected to a plurality of third hinge portions 61 provided on the second support member 60, and the third motor connection shaft 225 of the second door 220 is connected to a third motor 230 mounted on the second support member 60. Since the third hinge protrusions 224 and the third motor connection shaft 225 are coaxially provided, the second door 220 may be rotated by the third motor 230. The second door 220 may guide the air discharged from the second blowing port 210 by vertical rotation of the second door 220 in a vertical direction.

The air conditioner 1 according to one embodiment of the present invention may variously set and control the flow of the discharged air such as the direction, the volume, or the like of the discharged air due to the first door 120, the second door 220, and the guide blade 320.

Figure 6:
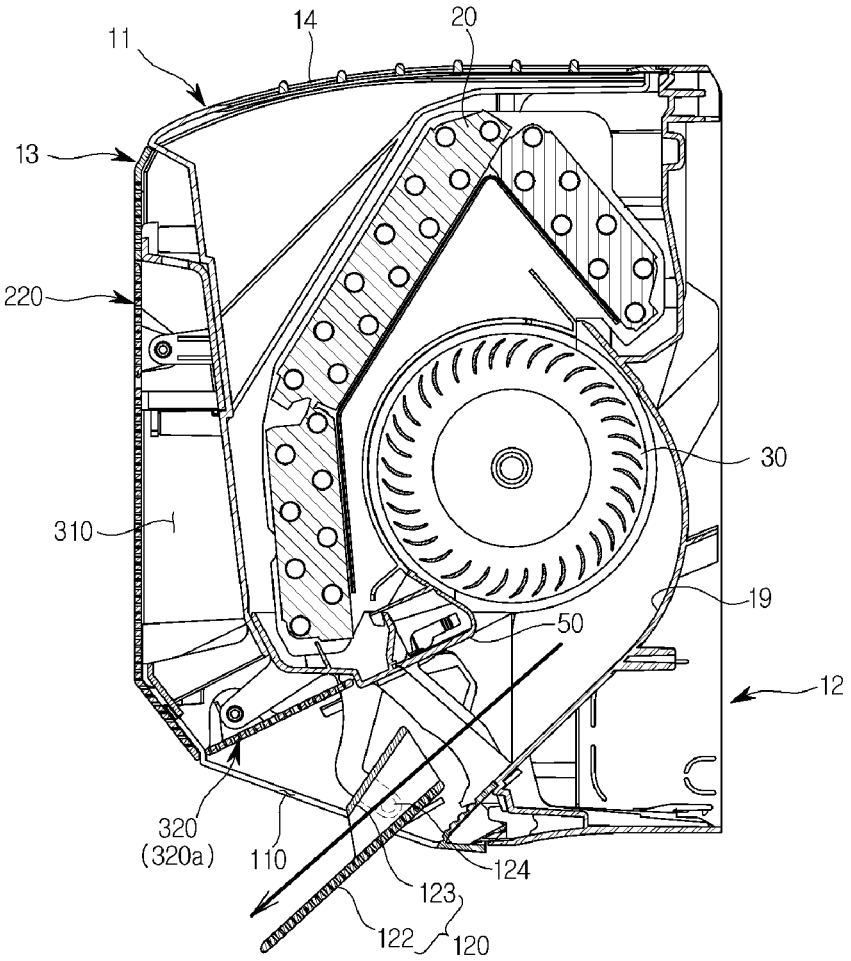
FIG. 6 is a cross-sectional view illustrating a downward wind mode state of the air conditioner according to one embodiment of the present invention.
Figure 7:
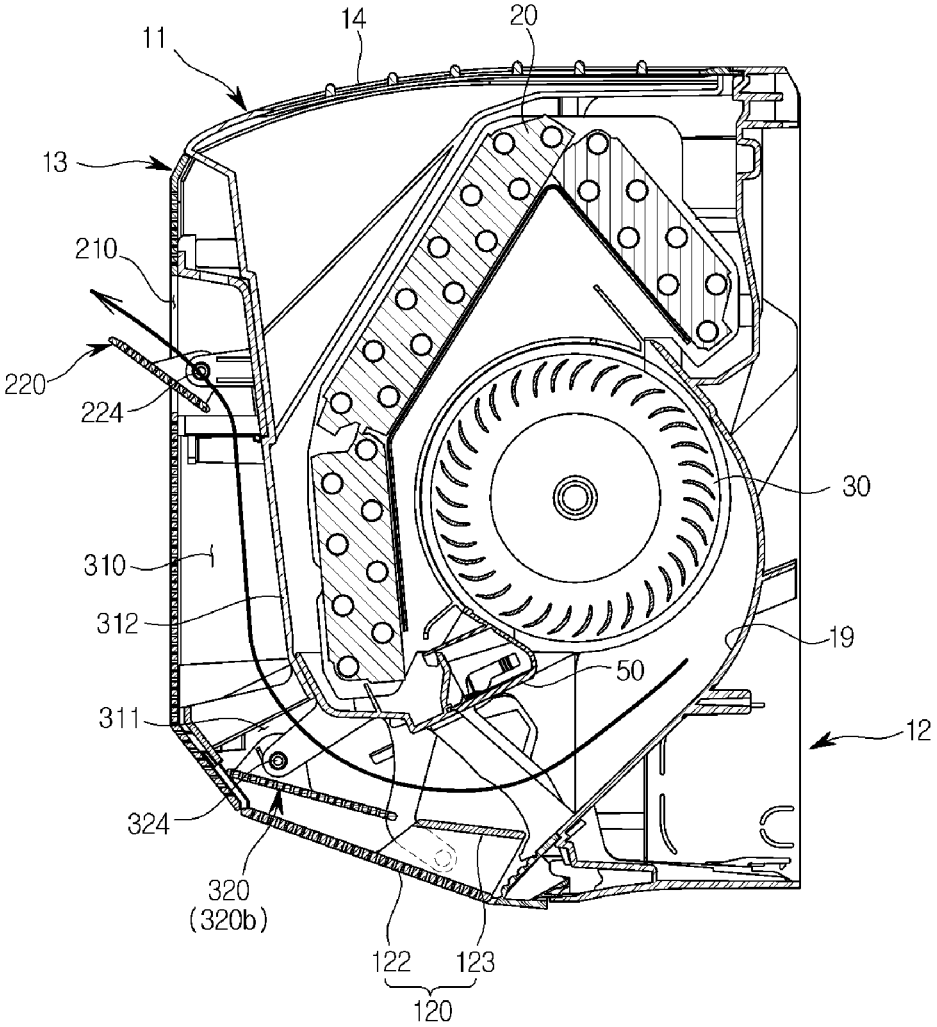
FIG. 7 is a cross-sectional view illustrating an upward wind mode state of the air conditioner according to one embodiment of the present invention.
Figure 8:
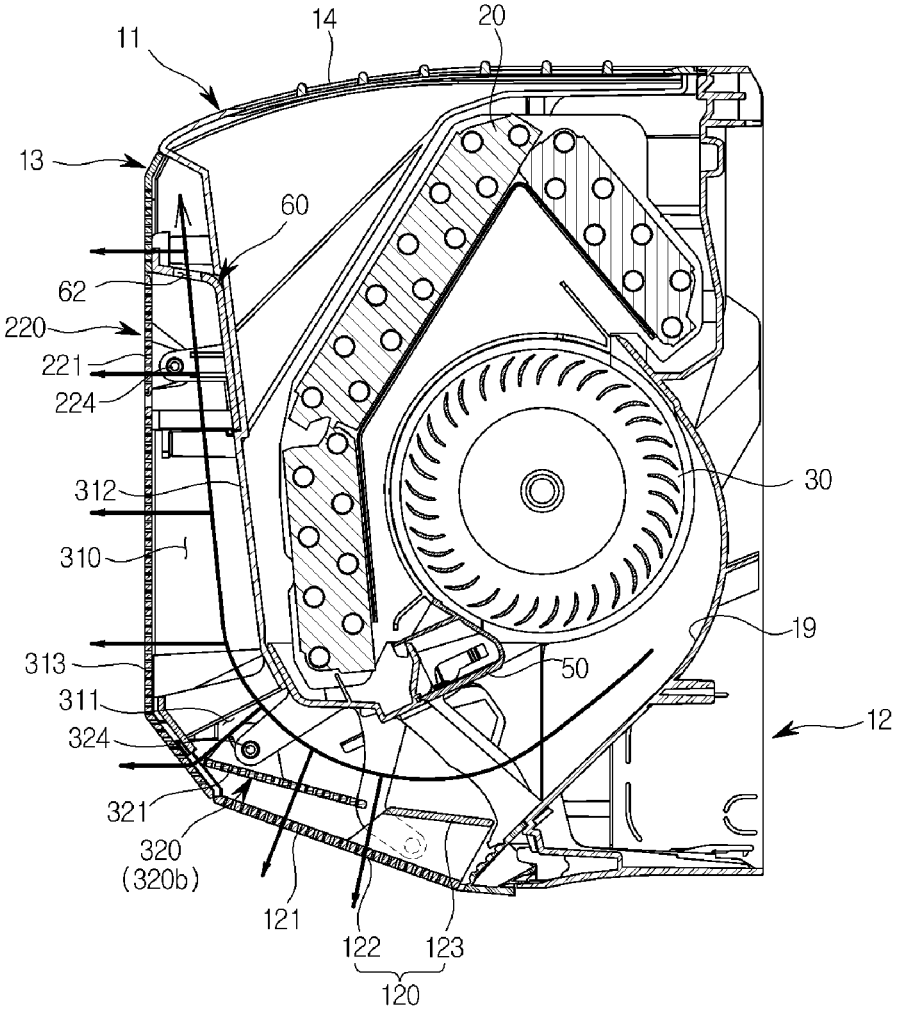
FIG. 8 is a cross-sectional view illustrating a windless mode state of the air conditioner according to one embodiment of the present invention.

FIG. 6 is a cross-sectional view illustrating a downward wind mode state of the air conditioner according to one embodiment of the present invention, FIG. 7 is a cross-sectional view illustrating an upward wind mode state of the air conditioner according to one embodiment of the present invention, and FIG. 8 is a cross-sectional view illustrating a windless mode state of the air conditioner according to one embodiment of the present invention.

Referring to FIG. 6, the first door 120 may rotate around the first hinge protrusions 124 to open the first blowing port 110, and the second door 220 may close the second blowing port 210. The first blowing port 110 may be provided in a lower portion of the housing 10, specifically in a lower surface of the rear housing 12, and when the air conditioner 1 is operated in a state in which the first blowing port 110 is open, wind having an air flow with a strong velocity and wind directions directed forward and downward may be discharged.

The air conditioner 1 according to the present invention may be installed on the wall, and assuming that the air conditioner 1 is installed on an upper side of the wall, an operation mode, in which the first blowing port 110 of the air conditioner 1 is open, is defined as a downward wind mode or a direct wind mode. In the direct wind mode, since a strong wind may be directly blown to the user, instant cooling or heating may be provided to the user, and indoor air conditioning may be quickly performed due to a strong velocity and a large volume of a wind.

The first door 120 may include the first blade 122 and the second blade 123, and the second blade 123 may be provided to overlap at least the part of the first blade 122. The second blade 123 may improve straightness of the air blown to the first blowing port 110. Accordingly, the first door 120 may easily control an air flow in a vertical direction due to second blade 123, and may blow the air at a faster velocity.

In the downward wind mode, the guide blade 320 may be located at a first position 320*a* which guides the air blown from the blowing fan 30 to a first path toward the first blowing port 110. That is, the guide blade 320 may close the entrance 311 of the duct 310 at the first position 320*a* so that the air blown from the blowing fan 30 does not head to the duct 310.

Referring to FIG. 7, the first door 120 may close the first blowing port 110, and the second door 220 may rotate around the third hinge protrusions 224 to open the second blowing port 210. The second blowing port 210 may be provided in a front surface of the housing 10, specifically in the front panel 13, and when the air conditioner 1 is operated in a state in which the second blowing port 210 is open, wind having an air flow with a strong velocity and wind directions directed forward and upward may be discharged.

The air conditioner 1 according to the present invention may be installed on the wall, and assuming that the air conditioner 1 is installed on an upper side of the wall, an operation mode, in which the second blowing port 210 of the air conditioner 1 is open, is defined as an upward wind mode or an indirect wind mode. In the indirect wind mode, cooling an indoor space is performed by convection without directly blowing wind to the user, and the indoor air conditioning may be quickly performed due to a strong velocity and a large volume of the wind.

In the second door 220, a lower end thereof may be hinge-coupled to the housing 10 so that the air discharged from the second blowing port 210 is guided in the upward direction. That is, the third hinge protrusions 224 provided on the second door 220 may be provided on the lower end of the second door 220, and the second door 220 may rotate around the third hinge protrusions 224 to guide the air discharged from the second blowing port 210 in the upward direction. Further, the second blowing port 210 may be disposed in an upper portion of the front panel 13 so that the air may be blown close to a ceiling.

In the upward wind mode, the guide blade 320 may rotate around the second hinge protrusions 324 to be located at a second position 320*b*. The guide blade 320 may guide the air blown from the blowing fan 30 to a second path toward the second blowing port 210, at the second position 320*b*. That is, the guide blade 320 may open the entrance 311 of the duct 310 at the second position 320*b* so that the air blown from the blowing fan 30 may head to the duct 310. Further, the guide blade 320 may close a path toward the first blowing port 110, with the second blade 123 of the first door 120 at the second position 320*b*.

Referring to FIG. 8, the first door 120 and the second door 220 may close the first blowing port 110 and the second blowing port 210, and the guide blade 320 may move to the second position 320*b* to open the entrance 311 of the duct 310. The plurality of third holes 313 may be provided to be uniformly disposed in the front panel 13 forming one surface of the duct 310, and when the first door 120 and the second door 220 close the first blowing port 110 and the second blowing port 210, the air blown from the blowing fan 30 may be discharged outward from the housing 10 through the plurality of third holes 313 formed in the front panel 13.

Since the plurality of third holes 313 may be formed in an upper portion of the second blowing port 210, the air blown from the blowing fan 30 may pass a through hole 62 provided in an upper portion of the second support member 60 and move to an upper end of the duct 310.

Further, the plurality of second holes 221 may be provided to be uniformly disposed in the second door 220, and when the first door 120 and the second door 220 close the first blowing port 110 and the second blowing port 210, the air blown from the blowing fan 30 may be discharged outward from the housing 10 through the plurality of second holes 221 formed in the second door 220.

The plurality of fourth holes 321 may be provided to be uniformly disposed in the guide blade 320. When the guide blade 320 is located at the second position 320*b* which guides the air blown from the blowing fan 30 to the second blowing port 210, and the first door 120 and the second door 220 close the first blowing port 110 and the second blowing port 210, the air blown from the blowing fan 30 may flow to the first blowing port 110 through the plurality of fourth holes 321 formed in the guide blade 320. Further, the air blown from the blowing fan 30 may also flow through a gap between the guide blade 320 and the second blade 123 of the first door 120.

The plurality of first holes 121 may be provided to be uniformly disposed in the first door 120, the air which flows through the plurality of fourth holes 321 or the gap between the guide blade 320 and the second blade 123 of the first door 120 may be discharged outward from the housing 10 through the plurality of second holes 121 formed in the second door 220.

When the air conditioner 1 is operated in a state in which the first blowing port 110 and the second blowing port 210 are closed, wind having an air flow with slow velocity and wind directions which are omnidirectionally spread may be discharged. An operation mode of the air conditioner 1 in the state in which the first blowing port 110 and the second blowing port 210 are closed is defined as a windless mode. In the windless mode, entire air conditioning of the indoor space may be slowly performed without directly blowing wind to a user.

In the downward wind mode, since the first blowing port 110 is open, the air blown from the blowing fan 30 forms a strong air flow heading to the first blowing port 110. Accordingly, an amount of the air blown from the blowing fan 30 and introduced into the duct 310 through the plurality of fourth holes 321 formed in the guide blade 320 is none or extremely small.

In the upward wind mode, since the second blowing port 210 and the entrance 311 of the duct 310 are open, the air blown from the blowing fan 30 forms a strong air flow heading to the second blowing port 210 by passing the duct 310. Accordingly, an amount of the air blown from the blowing fan 30 and discharged outward from the housing 10 through the plurality of first holes 121 formed in the first door 120 after passing the plurality of fourth holes 321 formed in the guide blade 320 is none or extremely small. Further, an amount of the air blown from the blowing fan 30 and discharged outward from the housing 10 through the plurality of third holes 313 formed in the housing 10 is also none or extremely small.

Since no blowing port is open in the windless mode, the air blown from the blowing fan 30 may be more weakly introduced into the duct 310 than when introduced in the upward wind mode. Further, the air blown from the blowing fan 30 may be discharged outward from the housing 10 through the plurality of first holes 121 formed in the first door 120, the plurality of second holes 221 formed in the second door 220, and the plurality of third holes 313 formed in the housing 10 at an entirely low velocity.

The plurality of first holes 121 formed in the first door 120, the plurality of second holes 221 formed in the second door 220, and the plurality of third holes 313 formed in the housing 10 may be formed to have an identical diameter. In this case, since all of the plurality of holes viewed from the outside have an identical diameter, aesthetics may be improved.

Meanwhile, the plurality of first holes 121 formed in the first door 120, the plurality of second holes 221 formed in the second door 220, and the plurality of third holes 313 formed in the housing 10 may each be formed to have different diameters. Preferably, each of the plurality of first holes 121 formed in the first door 120 may be formed to have a diameter different from those of each of the plurality of second holes 221 formed in the second door 220 and each of the plurality of third holes 313 formed in the housing 10. More preferably, each of the plurality of first holes 121 formed in the first door 120 may be formed to have a diameter smaller than that of each of the plurality of second holes 221 formed in the second door 220 and the plurality of third holes 313 formed in the housing 10.

Referring to FIG. 8, the first door 120 configured to cover the first blowing port 110 may be disposed most closely to the blowing fan 30, and the air blown from the blowing fan 30 may have a path bent by the guide blade 30 and the second blade 123 of the first door 120.

When all of the plurality of first holes 121 formed in the first door 120, the plurality of second holes 221 formed in the second door 220, and the plurality of third holes 313 formed in the housing 10 are formed to have an identical diameter, in the windless mode, a flow velocity of the air discharged through the plurality of first holes 121 provided in the first door 120 may be faster than that of the air discharged through the plurality of second holes 221 formed in the second door 220 and the plurality of third holes 313 formed in the housing 10.

When each of the plurality of first holes 121 formed in the first door 120 is formed to have a diameter smaller than those of each of the plurality of second holes 221 formed in the second door 220 and each of the plurality of third holes 313 formed in the housing 10, the air may be discharged at an identical flow velocity through the plurality of first holes 121 formed in the first door 120, the plurality of second holes 221 formed in the second door 220, and the plurality of third holes 313 formed in the housing 10.

Further, by other various factors, flow velocities of the air discharged through the plurality of first holes 121 formed in the first door 120, the plurality of second holes 221 formed in the second door 220, and the plurality of third holes 313 formed in the housing 10 may be different from each other. In this case, by discriminating the diameter of each of the plurality of first holes 121 formed in the first door 120, the diameter of each of the plurality of second holes 221 formed in the second door 220, the diameter of each of the plurality of third holes 313 formed in the housing 10 or a diameter of each of the plurality of fourth holes 321 formed in the guide blade 320, the air may be discharged at an identical flow velocity through the plurality of first holes 121 formed in the first door 120, the plurality of second holes 221 formed in the second door 220, and the plurality of third holes 313 formed in the housing 10.

Figure 9:
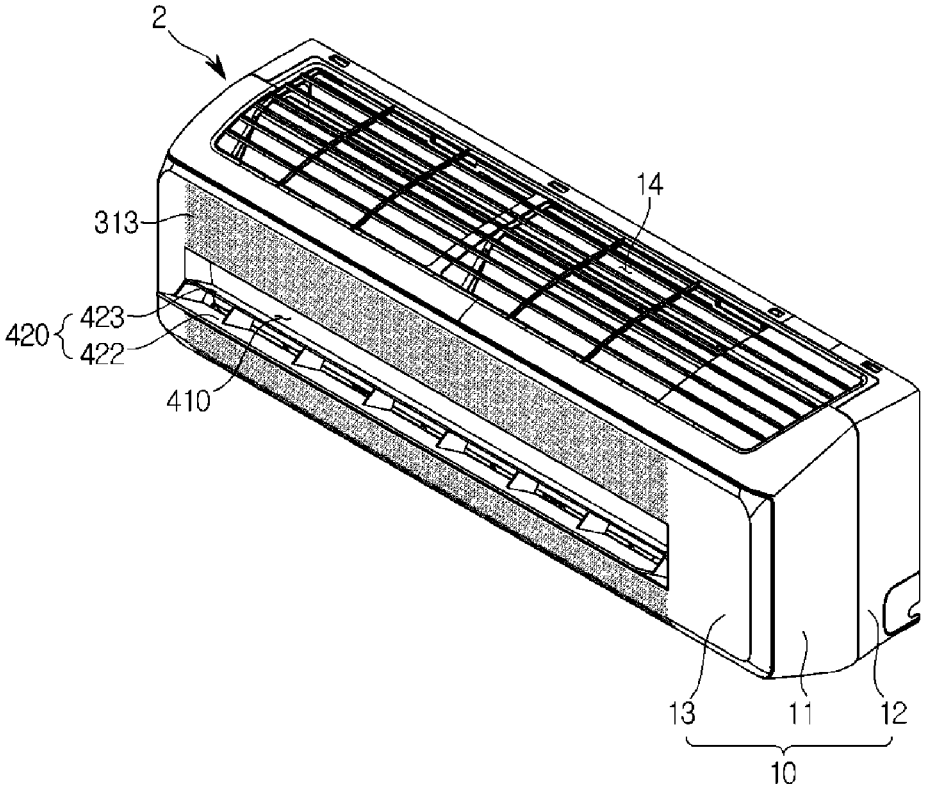
FIG. 9 is a perspective view of an air conditioner according to another embodiment of the present invention viewed from above.
Figure 10:
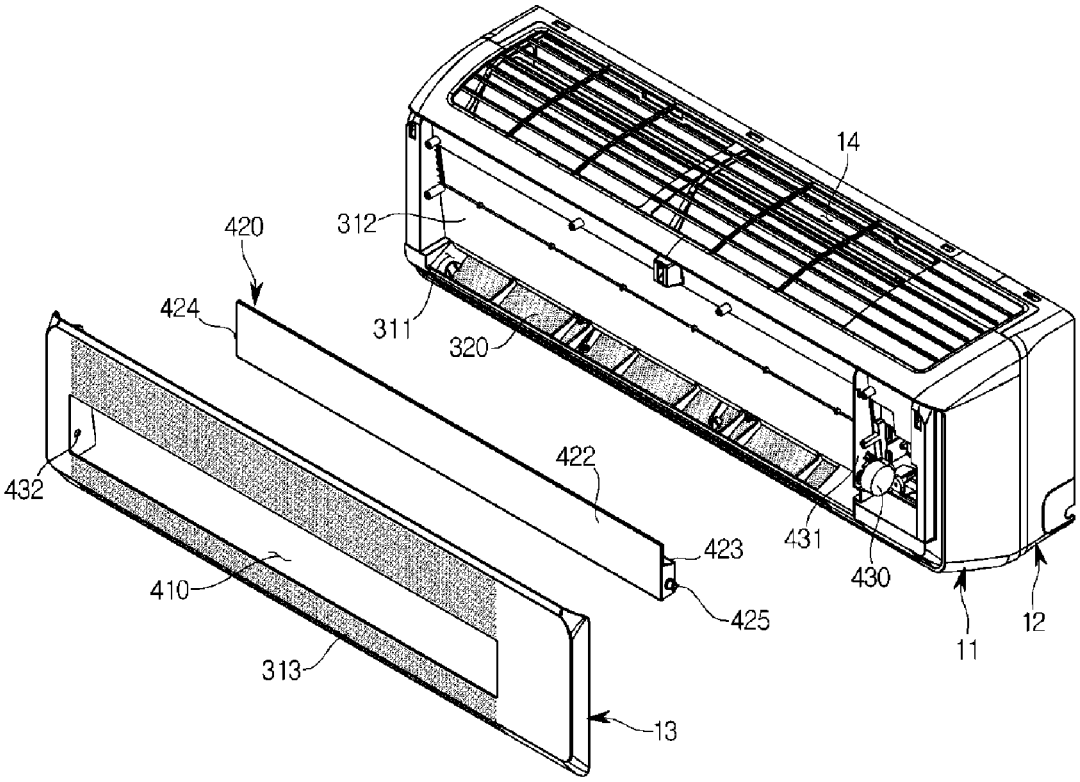
FIG. 10 is an exploded perspective view illustrating a partial configuration of the air conditioner according to another embodiment of the present invention.
Figure 11:
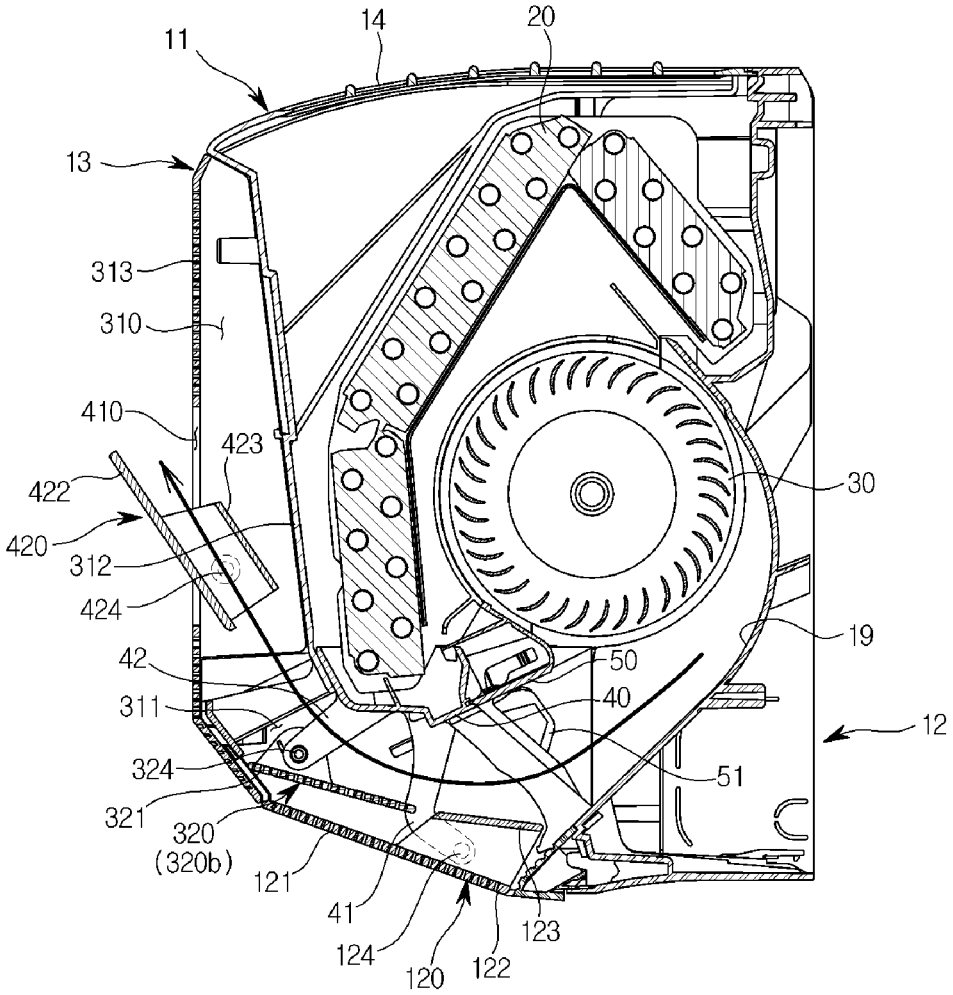
FIG. 11 is a cross-sectional view illustrating an upward wind mode state of the air conditioner according to another embodiment of the present invention.

FIG. 9 is a perspective view of an air conditioner according to another embodiment of the present invention viewed from above, FIG. 10 is an exploded perspective view illustrating a partial configuration of the air conditioner according to another embodiment of the present invention, and FIG. 11 is a cross-sectional view illustrating an upward wind mode state of the air conditioner according to another embodiment of the present invention.

Referring to FIGS. 9 to 11, an air conditioner 2 may include a housing 10 having a suction port 14 and blowing ports 110 and 410, a heat exchanger 20 disposed inside the housing 10 and configured to heat-exchange with air introduced into the housing 10, and a blowing fan 30 configured to suction the air into the housing 10 to flow the air to the blowing ports 110 and 410.

The air conditioner 2 may include the plurality of blowing ports 110 and 410. That is, the housing 10 of the air conditioner 2 may include a first blowing port 110 and a second blowing port 410. Further, the air conditioner 1 may include a first door 120 configured to open or close the first blowing port 110, and a second door 420 configured to open or close the second blowing port 410.

The housing 10 may have a rectangular parallelepiped shape of which a length of a widthwise direction is longer than a length of a lengthwise direction, and the first blowing port 110 and the second blowing port 410 may each be formed in a rectangular shape to correspond to the length of the housing 10. Further, the first door 120 and the second door 420 may each be formed in a rectangular shape to correspond to the first blowing port 110 and the second blowing port 410.

The first door 120 may include a plurality of first holes 121 to discharge the air inside the housing 10 when the first door 120 closes the first blowing port 110. Although not shown in the drawings, the second door 420 may include a plurality of second holes to discharge the air inside the housing 10 when the second door 420 closes the second blowing port 410.

Since the first blowing port 110 and the second blowing port 410 are each selectively opened or closed by the first door 120 and the second door 420, the air conditioner 2 may control a flow such as a direction, a volume, or the like of discharged air.

The housing 10 may include bodies 11 and 12, and a front panel 13 coupled to a front surface of each of the bodies 11 and 12. The bodies 11 and 12 may include the first blowing port 110, and the front panel 13 may include the second blowing port 410.

The air conditioner 2 may be provided to be installed on a wall. The bodies 11 and 12 may each include a rear housing 12 fixed to the wall and a front housing 11 coupled to the rear housing 12, and the front panel 13 may be coupled to a front surface of the front housing 11 of the housing 10.

The heat exchanger 20, the blowing fan 30 and the like may be accommodated in an inner space between the bodies 11 and 12 formed by the front housing 11 and the rear housing 12. The suction port 14 capable of suctioning air into the inner space between the bodies 11 and 12 may be provided in an upper portion of the front housing 11. Further, the first blowing port 110 capable of blowing the air blown from the blowing fan 30 outward from the housing 10 may be installed in a lower portion of the front housing 11.

The front panel 13 may form a duct 310 together with at least a part 312 of the bodies 11 and 12. Specifically, the duct 310 may be formed by the front panel 13 and a front outer side surface 312 of the front housing 11. The front panel 13 may include the second blowing port 410, and the duct 310 may provide a path through which air blown from the inner space between the bodies 11 and 12 may flow to the second blowing port 410.

The air conditioner 2 may include a guide blade 320 configured to open or close an entrance 311 of the duct 310. The guide blade 320 may be configured to be movable to a first position which guides the air blown from the blowing fan 30 to the first blowing port 110, and to a second position which guides the air blown from the blowing fan 30 to the second blowing port 410. That is, the guide blade 320 may be configured to be movable to the first position in which the entrance 311 of the duct 310 is closed and the second position in which the entrance of the duct 310 is open.

The housing 10 may include a plurality of third holes 313 to discharge the air in the housing 10 when the first blowing port 110 and the second blowing port 410 are closed. Specifically, the front panel 13 may include the plurality of third holes 313 configured to discharge the air from the periphery of the second blowing port 410. Although not shown in the drawings, the plurality of third holes 313 may also be formed in a side surface, a lower surface, or the like of the housing 10.

The air conditioner 2 may discharge the air in the housing 10 through the plurality of first holes 121 formed in the first door 120 and the plurality of third holes 313 formed in the housing 10 when the first blowing port 110 and the second blowing port 410 are closed. Although not shown in the drawings, in the case in which the plurality of second holes are formed in the second door 420, the air in the housing 10 may also be discharged through the plurality of second holes when the first blowing port 110 and the second blowing port 410 are closed.

The first door 120 may include a plurality of first hinge protrusions 124 and a first motor connection shaft 125. The plurality of first hinge protrusions 124 of the first door 120 are connected to a plurality of first hinge portions 41 provided on a first support member 40, and the first motor connection shaft 125 of the first door 120 is connected to a first motor 130 mounted in the first support member 40. Since the first hinge protrusions 124 and the first motor connection shaft 125 are coaxially provided, the first door 120 may be rotated by the first motor 130. The first door 120 may guide air discharged from the first blowing port 110 by vertical rotation of the first door 120 in a vertical direction.

The first door 120 may include a first blade 122 configured to open or close the first blowing port 110, and a second blade 123 spaced apart from the first blade 122 and configured to overlap at least a part of the first blade 122. That is, the second blade 123 may be provided to be spaced apart from first blade 122, but may be formed to have a lengthwise width smaller than that of the first blade 122.

The plurality of first holes 121 formed in the first door 120 may be formed in the first blade 122. Although not shown in the drawings, the plurality of first holes may also be formed in the second blade 123.

The housing 10 may include a second support member 431 on which a third motor 430 capable of driving the second door 420 may be mounted. The second support member 431 may be attached to the front outer side surface 312 of the front housing 11.

The second door 420 may include a plurality of third hinge protrusions 424 and a third motor connection shaft 425. The plurality of third hinge protrusions 424 of the second door 420 are connected to a third hinge portions 432 provided to protrude from a rear surface of the front panel 13, and the third motor connection shaft 425 of the second door 420 is connected to the third motor 430 mounted on the second support member 431. Since the third hinge protrusions 424 and the third motor connection shaft 425 are coaxially provided, the second door 420 may be rotated by the third motor 430. The second door 420 may guide air discharged from the second blowing port 410 by vertical rotation of the second door 420 in a vertical direction.

The second door 420 may include a third blade 422 configured to open or close the second blowing port 410, and a fourth blade 423 spaced apart from the fourth blade 422 and configured to overlap at least a part of the third blade 422. That is, the fourth blade 423 may be provided to be spaced apart from the third blade 422, but may be formed to have a lengthwise width smaller than that of the third blade 422.

Although not shown in the drawings, the plurality of second holes may be formed in the third blade 422 of the second door 420. Further, the plurality of second holes may also be formed in the fourth blade 423.

Descriptions of the components among the components of the air conditioner 2 according to the embodiment shown in FIGS. 9 to 11 identical to the components of the air conditioner 1 according to the embodiment shown in FIGS. 1 to 8 will be omitted.

The air conditioner 2 according to another embodiment of the present invention may variously set and control the flow such as a direction, a volume, or the like of the discharged air due to the first door 120, the second door 420, and the guide blade 320.

Referring to FIG. 11, the first door 120 may close the first blowing port 110, and the second door 420 may rotate around the third hinge protrusions 424 to open the second blowing port 410. The second blowing port 410 may be provided in a front surface of the housing 10, specifically in the front panel 13, and when the air conditioner 1 is operated in a state in which the second blowing port 410 is open, wind having an air flow with a strong velocity and wind directions directed forward and upward may be discharged.

The air conditioner 2 according to the present invention may be installed on the wall, and assuming that the air conditioner 2 is installed on an upper side of the wall, an operation mode, in which the second blowing port 410 of the air conditioner 2 is open, is defined as an upward wind mode or an indirect wind mode. In the direct wind mode, cooling an indoor space is performed by convection without directly blowing wind to a user, and the indoor air conditioning may be quickly performed due to a strong velocity and a large volume of the wind.

In the second door 420, a lower end thereof may be hinge-coupled to the housing 10 so that the air discharged from the second blowing port 410 may be guided in the upward direction. That is, the third hinge protrusions 424 provided on the second door 420 may be provided on the lower end of the second door 420, and the second door 420 may rotate around the third hinge protrusions 424 to guide the air discharged from the second blowing port 410 in the upward direction.

In the upward wind mode, the guide blade 320 may rotate around the second hinge protrusions 324 to be located at a second position **320*b*. The guide blade 320 may guide the air blown from the blowing fan 30 to a second path toward the second blowing port 410, at the second position 320***b*. That is, the guide blade 320 may open the entrance 311 of the duct 310 at the second position 320*b* so that the air blown from the blowing fan 30 may head to the duct 310. Further, the guide blade 320 may close a path facing the first blowing port 110 together with the second blade 123 of the first door 120 at the second position 320*b*.

The second blowing port 420 may be disposed at a center of the front panel 13. When the second blowing port 420 is disposed at the center of the front panel 13, the air blown from the blowing fan 30 and bent by the second blade 123 and the guide blade 320 of the first door 120 may be directly blown in the upward direction without being bent at the second blowing port 420. That is, when the second blowing port 420 is disposed at the center of the front panel 13, the air blown from the blowing fan 30 through the second blowing port 420 may be discharged at a fast velocity.

The second door 420 may include the third blade 422 and the fourth blade 423, and the fourth blade 423 may be provided to overlap at least the part of the third blade 422. The fourth blade 423 may improve straightness of the air blown to the second blowing port 410. Accordingly, the second door 420 may easily control an air flow in a vertical direction due to the fourth blade 423, and may blow the air at a faster velocity.

Identical or similar to the embodiment shown in FIGS. 6 and 8, the air conditioner 2 may be operated in a downward wind mode and a windless mode.

The scope of the present disclosure is not limited to the above-described embodiments. Various other embodiments changeable and transformable by those skilled in the art may be considered as being within the scope of the present disclosure without departing from the spirit of the present disclosure specified in the claims.

The invention claimed is:

1. An air conditioner comprising:

a housing having a first blowing port and a second blowing port;

a blowing fan configured to suction air into the housing;

a first door including a first blade configured to open or close the first blowing port, and a second blade fixed to the first blade;

a second door configured to open or close the second blowing port; and a guide blade configured to be movable to a first position in which the guide blade closes an entrance to a duct leading to the second blowing port so that air blown from the blowing fan is guided to the first blowing port, and a second position in which the guide blade opens the entrance to the duct, at least partially overlaps with the first blowing port, and closes a path toward the first blowing port together with the second blade, so that air blown from the blowing fan is guided to the second blowing port.

2. The air conditioner of claim 1, wherein the first blade includes a plurality of holes to, with the first blade closing the first blowing port, discharge air inside the housing through the first blade and then through the first blowing port to outside of the housing.

3. The air conditioner of claim 2, wherein the second blade is spaced apart from the first blade and configured to overlap at least a part of the first blade.

4. The air conditioner of claim 1, wherein the second door includes a plurality of holes to, with the second door closing the second blowing port, discharge air inside the housing through the second door and then through the second blowing port to outside of the housing.

5. The air conditioner of claim 4, wherein the second door includes a first blade configured to open or close the second blowing port, and a second blade spaced apart from the first blade of the second door and configured to overlap at least a part of the first blade of the second door.

6. The air conditioner of claim 5, wherein the plurality of holes of the second door are formed in the first blade of the second door.

7. The air conditioner of claim 1, wherein a lower end of the second door is hinge-coupled to the housing so that air discharged from the second blowing port is guided in an upward direction.

8. The air conditioner of claim 1, wherein the housing includes a plurality of holes to discharge air inside the housing through the housing, with the first blade of the first door closing the first blowing port and the second door closing the second blowing port.

9. The air conditioner of claim 1, wherein the guide blade includes a plurality of holes to flow air through the guide blade to the first blowing port while the guide blade is in the second position.

10. An air conditioner comprising:

a housing having a first blowing port and a second blowing port;

a blowing fan configured to suction air into the housing;

a first door configured to open or close the first blowing port, and having a plurality of holes formed therein;

a second door configured to open or close the second blowing port; and a guide blade configured to be movable to a first position in which the guide blade closes an entrance to a duct leading to the second blowing port so that air blown from the blowing fan is guided to the first blowing port, and a second position in which the guide blade opens the entrance to the duct and at least partially overlaps with the first blowing port so that air blown from the blowing fan is guided to the second blowing port, wherein the first door and the guide blade are configured so that, when the guide blade is in second position with the first door closing the first blowing port and the second door closing the second blowing port, at least a portion of air blown from the blowing fan passes through the guide blade, or past an end of the guide blade, and then through the plurality of holes formed in the first door, to thereby pass through the first blowing port.

11. An air conditioner comprising:

a housing having a first blowing port and a second blowing port;

a blowing fan configured to suction air into the housing;

a first door configured to open or close the first blowing port, and having a plurality of holes formed therein;

a second door configured to open or close the second blowing port, and having a plurality of holes formed therein; and a guide blade, having a plurality of holes formed therein, and configured to be movable to a first position in which the guide blade closes an entrance to a duct leading to the second blowing port so that air blown from the blowing fan is guided to the first blowing port, and a second position in which the guide blade opens the entrance to the duct and at least partially overlaps with the first blowing port so that air blown from the blowing fan is guided to the second blowing port, wherein, when the guide blade is in second position with the first door closing the first blowing port and the second door closing the second blowing port, a portion of air blown from the blowing fan passes through the plurality of holes formed in the guide blade and then through the plurality of holes formed in the first door, to thereby pass through the first blowing port, and another portion of air blown from the blowing fan passes through the entrance to the duct and then passes through the plurality of holes in the second door to thereby pass through the second blowing port.

* * * * *